United States Patent [19]

Miller

[11] 4,432,268

[45] Feb. 21, 1984

[54] DETONATION CUT-OFF DEVICE

[75] Inventor: Kenneth A. Miller, West Jordan, Utah

[73] Assignee: Ireco Chemicals, Salt Lake City, Utah

[21] Appl. No.: 408,340

[22] Filed: Aug. 16, 1982

[51] Int. Cl.[3] ..... F42B 33/00; F42D 5/00

[52] U.S. Cl. ..... 86/1 R; 86/1 B; 102/275.1; 102/275.2; 102/275.12; 102/304; 102/323; 102/331

[58] Field of Search ..... 86/1 B, 1 R; 102/304, 102/323, 275.2, 275.12, 275.1, 331

[56] References Cited

U.S. PATENT DOCUMENTS 3,368,485 2/1968 Klotz ..... 102/275.2

*Primary Examiner*—Leland A. Sebastian
*Assistant Examiner*—Joel P. Okamoto

[57] ABSTRACT

A passive detonation cut-off device for a solid line of explosives operates by directionally controlling the detonation pressure of an accidental detonation wave of an explosives line and by using this directionally controlled detonation pressure to sever the explosives line to prevent further propogation of the detonation wave. The device comprises a body having two through holes extending through the body and at least one blast hole connecting the through holes and extending from one of the through holes to the outside of the body.

9 Claims, 3 Drawing Figures

DETONATION CUT-OFF DEVICE

The present invention relates to an explosives line detonation cut-off device for stopping an accidental detonation from traveling up the explosives line to its supply source. More specifically, the cut-off device comprises a body, preferably in the form of a parallelepiped or block, having two through holes through which an explosives line such as detonating cord is threaded and at least one blast hole connecting the through holes and extending from one of the through holes to the outside of the body. As is explained in more detail below, this arrangement of holes will consistently stop a detonation from traveling through the detonation cut-off device. The device is simple with no mechanical parts.

Various means have been used in the prior art to minimize the chance of propagation of an accidental detonation through a pipeline or duct of fluid explosive materials, such as TNT, which may be transported in molten form. Such prior art detonation trap devices operate by insertion of a barrier or plug into the explosive stream. Others employ air gaps or the injection of a foreign material, such as water, to quench the detonation wave by changing the state of the explosive fluid line. The detonation trap disclosed in U.S. Pat. No. 4,149,447 is a non-mechanical or passive type of trap designed to arrest the detonation wave by insertion of a manifold between an off-set pipeline arrangement. A need exists, however, for a detonation cut-off device for a solid line of explosive material such as detonating cord. The device of the present invention fulfills this need.

SUMMARY OF THE INVENTION

The present invention relates to a passive (non-mechanical) detonation cut-off device for a solid line of explosives such as detonating cord or a continuous line of packaged slurry explosive. The device operates by directionally controlling the detonation pressure of an accidental detonation wave of an explosives line and by using this directionally controlled detonation pressure to sever the explosives line to prevent further propagation of the detonation wave. The explosives line is severed in such a way that the explosive material actually is removed from the path of the detonation wave thereby creating an air gap in the explosives line and thus precluding further propagation of the detonation wave. This result is accomplished by the proper arrangement of holes through the body of the device. Two preferably parallel through holes are connected preferably perpendicularly by one or more blast holes which extend through one of the through holes to the outside of the body. The detonation pressure created by an accidental detonation is directed through the blast hole(s) to the outside of the body. This detonation pressure intercepts and severs the explosives line as the detonation pressure exits the body. The severed portion of the explosives line is expelled out the body by the detonation pressure. By employing more than one blast hole, the explosives line can be severed at more than one point to provide a margin of safety.

DESCRIPTION OF THE PREFERRED EMBODIMENTS

Figure 1:
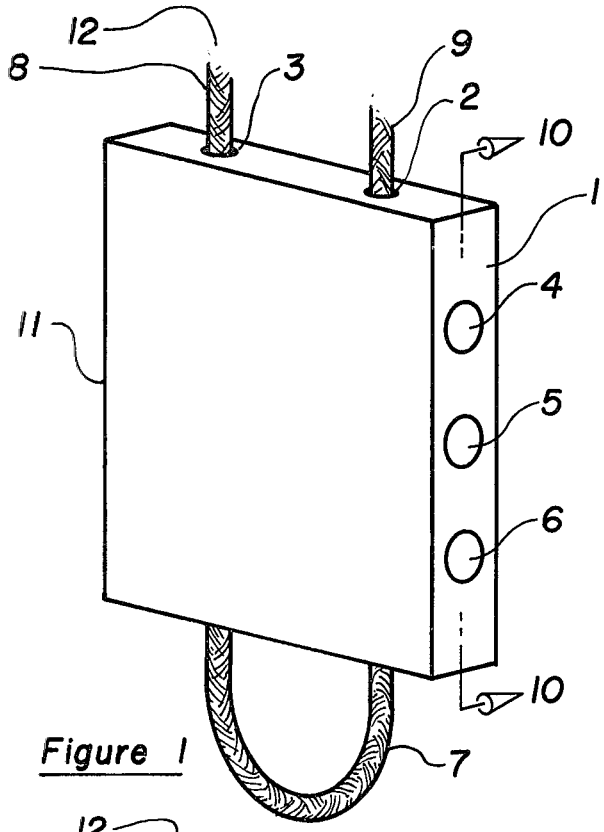
FIG. 1 is a perspective of the detonation cut-off device indicating three horizontal blast holes and two vertical through holes through which an explosives line is threaded in such a manner as to form a loop.
Figure 2:
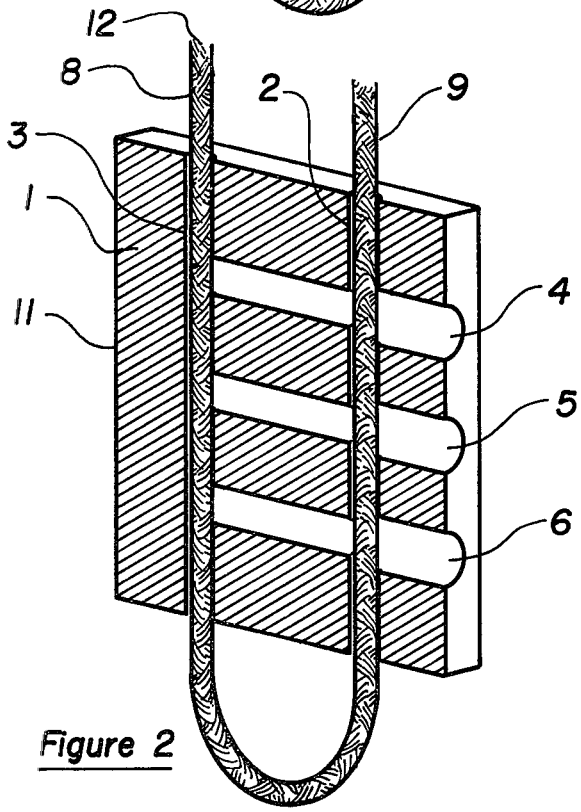
FIG. 2 is a cross-sectional perspective view of the detonation cut-off device taken along line 10—10 of FIG. 1.

Referring to FIGS. 1 and 2, a detonation cut-off device 11 contains two through holes 2 and 3. These through holes extend through the body 1 of the device as shown. The through holes preferably are parallel although they could be angled. An explosives line 12 is threaded through the through holes forming a loop portion 7. Supply side explosives line 9 is the supply end of the line and runs to a supply source such as a reel of explosive line (not shown). Use side explosives line 8 is the use end of the line where any accidental detonation likely would occur. Perpendicularly connecting through holes 2 and 3 are blast holes 4, 5 and 6 which open to the outside of the body 1 through the supply side through hole 2. Preferably, the blast holes are perpendicular to the through holes and increase in diameter on the exit side of through hole 2. This preferred embodiment is shown in FIG. 2. As shown, the blast holes connect the through holes. At least one blast hole is required, but preferably three or more are employed.

In operation, a detonation initiated in the use side explosive line 8 will travel up explosives line 8 and into the detonation cut-off device 11 toward the supply side explosives line 9 and potentially to the supply source (not shown) of the explosives line 9. As the detonation reaches the blast holes 4, 5 and 6, the gases created upon detonation of the explosives line are confined in all sides except out through the blast holes. Thus the detonation pressure created by these gases is directed out the blast holes with sufficient force to sever explosives line 9 at each intersection of the blast holes with through hole 2. This severance occurs before the detonation wave can travel through explosives line loop portion 7 and back into the body 1. When the detonation wave reaches the intersections of the blast holes with through hole 2, the supply side explosives line 9 has been severed at these intersections and blown out of the body at the blast hole openings thereby preventing further propagation of the detonation. This prevents the detonation from traveling up supply side explosives line 9 to a supply source.

Testing was performed on a series of aluminum blocks measuring three inches in length and $\frac{3}{4}$-inch in thickness. The width varied depending upon through hole spacing. Each block had two $\frac{1}{4}$-inch diameter, parallel through holes drilled through the 3-inch length of the block. Each block also had blast holes drilled perpendicular to the through holes in the block. The blast holes were arranged as shown in FIG. 2. The diameters of the blast holes between the through holes were $\frac{1}{4}$-inch and the diameters of the portions of the blast holes exiting from the supply side through hole 2 were $\frac{3}{8}$-inch. The blast holes were spaced parallel to each other at varying distances. Variable spacings between through holes and variable numbers of blast holes and spacings between blast holes were tested to determine minimum and maximum distances and numbers that would work successfully. These test results are summarized in Table I below.

TABLE I

| Cut-off Device Test Data (PRIMEX 50 gr cord used) | | |
|---|---|---|
| Through Hole Spacing | # Blast Holes/distance apart | Results |
| ½" | 5/½" apart | Fail |
| ¾" | 3/1" apart | Cut-off |
| 1¼" | 3/1" apart | Cut-off |
| 1¼" | 1/ centered | Cut-off |
| 1½" | 5/½" apart | Cut-off |
| 1¾" | 5/½" apart | Cut-off |
| 2" | 5/½" apart | Cut-off |
| 2¼" | 5/½" apart | Cut-off |
| 2½" | 5/½" apart | Cut-off |
| 2¾" | 5/½" apart | Fail* |
| 3" | 5/½" apart | Cut-off |

*loop was believed to be too short on this test.

Successful operation of the detonation cut-off device is based upon the following formula:

$$A/B > X/Y$$

Where

A = length of the loop portion 7,

B = velocity of detonation in the explosives line,

X = distance between the through holes, and

Y = velocity of gas pressure generated in through hole 3 and released out of blast holes.

The above velocities must be determined experimentally. If A/B is less than X/Y, the detonation cut-off device will fail. The length of the loop portion 7 easily can be adjusted to satisfy the above formula. Preferably the loop portion is placed around a fixed pulley so that the length of the loop portion remains constant.

It has been found that when the explosives line is 50 grain detonating cord, the minimum through hole spacing is ¾ inch. No maximum has been established. A ½ inch spacing will not produce a detonation cut-off. A preferred device for 50 grain detonating cord is an aluminum block having 19 blast holes and a 2½-inch spacing between the two through holes. The length of the loop portion is 36 inches.

Figure 3:
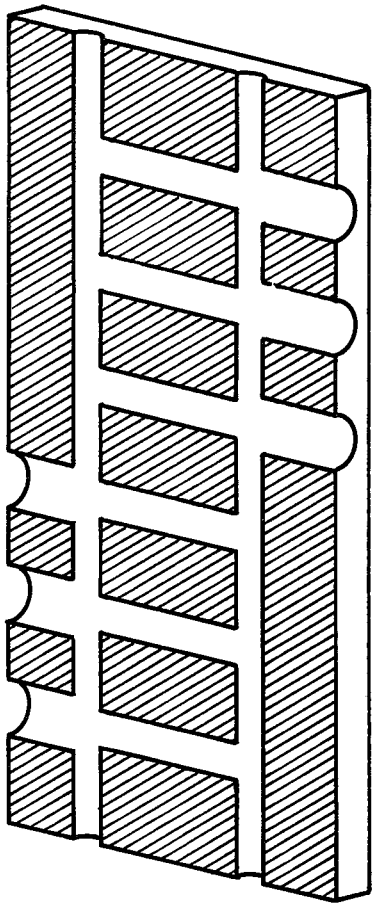
FIG. 3 is a cross-sectional perspective view of a modified detonation cut-off device.

FIG. 3 shows a modified detonation cut-off device that works on the same principles as described above but that is capable of cutting off detonations originating at either the supply end or the use end of the explosives line. This is accomplished by using two, oppositely directed sets of blast holes, as shown.

The above described detonation cut-off device will stop an accidental detonation from traveling up an explosives line to its source such as a supply reel. The device is simple, passive and thus maintenance free, and does not interfere with the free movement of the explosives line through the device. Once the line has been threaded through the device, an operator is not able to bypass or eliminate the device which is important for safety reasons. Preferably the device is affixed in relation to a pulley to maintain the desired length of the loop portion 7 as previously explained. The device can be used with detonating cord or any other type of explosive line.

While the present invention has been described with reference to certain illustrative examples and preferred embodiments, various modifications are intended to be within the scope of the invention as set forth in the appended claims.

What is claimed is:

1. A directionally controlled, detonation pressure actuated explosives line detonation cutoff device comprising a body having two through holes extending through the body and at least one blast hole connecting the through hole and extending from one of the through holes to the outside of the body, whereby detonation pressure is directed through the blast hole to sever an explosive line contained in the through holes.

2. A device according to claim 1 wherein the body is a parallelepiped.

3. A device according to claim 1 wherein the two through holes are parallel.

4. A device according to claim 3 wherein the blast hole or holes are perpendicular to the through holes.

5. A device according to claim 1 additionally containing a detonating cord threaded through each through hole in a manner so as to form a loop of cord between the through holes.

6. A device according to claim 5 wherein A/B > X/Y, where A = the length of the loop of cord, B = the velocity of detonation of the cord, X = the length of the blast hole or holes between the through holes, and Y = the velocity through the blast hole of the detonation pressure of the cord.

7. A device according to claim 6, wherein the detonating cord is 50 grain and the distance between the through holes is at least ¾ inch.

8. A device according to claim 1 having at least two oppositely directed blast holes which thus extend to the outside of the body on opposite sides.

9. A device according to claim 8 having at least two sets of oppositely directed blast holes.

* * * * *